United States Patent [19]

Holloway

[11] Patent Number: 4,816,622

[45] Date of Patent: Mar. 28, 1989

[54] JOYSTICK ASSEMBLIES

[75] Inventor: Wynford Holloway, Wavell Close Cardiff, United Kingdom

[73] Assignee: Creative Devices Research Limited, Tredegar, United Kingdom

[21] Appl. No.: 161,788

[22] Filed: Feb. 29, 1988

Related U.S. Application Data

[63] Continuation of Ser. No. 928,908, Nov. 10, 1986, abandoned.

[51] Int. Cl.[4] ..... H01H 25/04; A63F 9/22; G09G 3/02

[52] U.S. Cl. ..... 200/6 A; 340/709

[58] Field of Search ..... 200/5 A, 6 A, 52 R, 200/157; 273/85 G, 148 B, DIG. 028; 340/709

[56] References Cited

U.S. PATENT DOCUMENTS

| | | | |
|---|---|---|---|
| 2,791,664 | 5/1957 | Rohacs | 200/157 |
| 3,156,134 | 11/1964 | Forrester, Jr. | 200/6 A X |
| 3,198,922 | 8/1965 | Rohacs | 200/157 |
| 3,271,532 | 9/1966 | Lopez | 200/6 A |
| 3,700,835 | 10/1972 | Rackson | 200/52 R |
| 3,708,636 | 1/1973 | Sobchak | 200/6 A |
| 3,731,013 | 5/1973 | Nightengale | 200/6 A X |
| 4,181,827 | 1/1980 | Diepeveen | 200/6 A |
| 4,382,166 | 5/1983 | Kim | 200/6 A |
| 4,459,440 | 7/1984 | Wiczer | 200/6 A |
| 4,552,360 | 11/1985 | Bromley et al. | 340/709 X |
| 4,604,502 | 8/1986 | Thomas | 200/6 A |
| 4,739,128 | 4/1988 | Grisham | 340/709 X |

OTHER PUBLICATIONS

"Peripherals: Roadwars and Joysticks," *The New York Times,* 7/5/88, p. C8 (New York Edition).

*Primary Examiner*—J. R. Scott
*Attorney, Agent, or Firm*—Edwin D. Schindler

[57] ABSTRACT

The joystick assembly comprises an ergonomically shaped, hand-holdable housing. The joystick shaft passes through an upper face of the housing and the lower end of the shaft is pivotably received in a ball and socket joint. The shaft is pivotable about the joint such that an intermediate portion of the shaft can engage a selected one, or a selected two, of an array of four microswitches each arranged for completing electrical connection to a VDU display. The shaft is biassed towards the neutral position solely by the four microswitches.

46 Claims, 2 Drawing Sheets

JOYSTICK ASSEMBLIES

This application is a continuation of application Ser. No. 928,908, filed Nov. 10, 1986, now abandoned.

FIELD OF THE INVENTION

The present invention is concerned with joystick assemblies for use, for example, for the control of video games and as computer peripherals.

BACKGROUND OF THE INVENTION

Joystick assemblies conventionally comprise a box-like housing and a control lever (or "joystick") extending through the top of the housing. Switches (typically microswitches) or contacts within the housing are electrically connected with an input to, for example, a video game, and are arranged to be actuated by the joystick in response to manual manipulation thereof, so that horizontal and/or vertical movement of an image on a VDU display screen can be thereby controlled.

The joystick shaft has a neutral position which is generally perpendicular to the plane of the switches or contacts and is movable about the x-y axes to control the position of a discrete image element on a display screen. The control is effected by pivotal movement of the joystick away from the neutral position to a selected position in which any one of the switches or contacts, or any adjacent pair thereof, is contacted by the shaft. The use of four mutually perpendicular switches can provide eight distinct switching positions.

Known joystick assemblies of this type have the joystick shaft pivotable about the point at which it passes through the top of the housing, with the lower end of the shaft making contact with the contacts or the switches in the appropriate switching positions. This inevitably means that the distance of travel of the free end of the shaft is greater than the distance of travel at an intermediate position such as around the pivot zone. The arrangements for ensuring pivoting of the shaft are generally complicated in construction.

It is an object of the present invention to provide a joystick assembly in which the switch actuating portion of the shaft has a minimal distance of travel.

It is a further object of the present invention to provide a joystick assembly with a very rapid response time.

It is yet a further object of the invention to provide a joystick assembly of simple construction, with a minimum of moving mechanical parts.

It is still a further object of the invention to provide a joystick assembly with a housing of ergonomic design which can fit comfortably in the palm of a user's hand.

SUMMARY OF THE INVENTION

Accordingly, in the joystick assembly according to the invention, there are four switches spaced 90° apart and surrounding the shaft of the joystick, the end of the latter being pivotally mounted in a seat in the base of the housing.

The shaft is preferably retained in its equilibrium position by resilient biassing means present in each of the switches.

The foregoing and other objects and features of the present invention will be apparent and more fully understood from the following detailed description of a preferred embodiment of the present invention, in which reference will be made to the accompanying drawings.

PREFERRED EMBODIMENT

Figure 1:
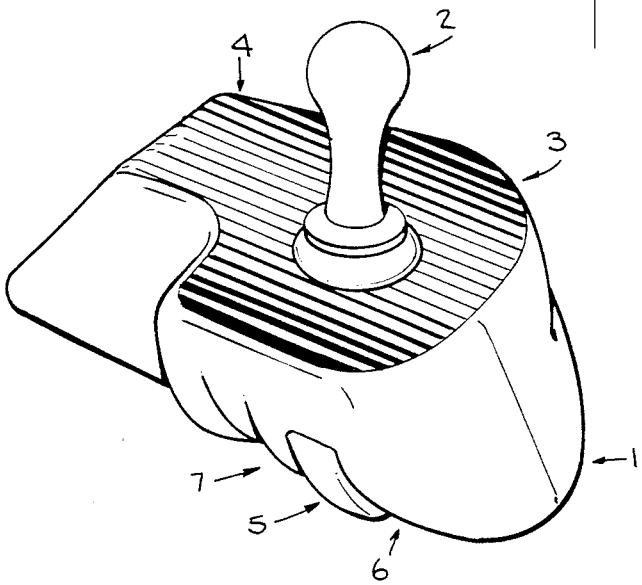
FIG. 1 is a perspective view of a housing incorporating a joystick assembly according to invention.

Referring to FIG. 1, the joystick assembly illustrated comprises a hand-holdable housing 1 having an upwardly extending joystick lever 2 passing through the upper face 3 thereof. The housing 1 is ergonomically shaped such that it can be fitted in the palm of the (left) hand, with the thumb received in a groove 4 in one sidewall and the index finger in contact with the fire button 5 located in a bulbous projection 6 at one end of the housing 1. The third and fourth fingers of the user are received in a recess 7. Joystick lever 2 is itself operable by the user's right hand while the housing is held in the user's left hand.

The joystick assembly is particularly adapted for electrical connection and use with a computer game, in which the joystick lever is manually manipulated for selective control over movement of an image on a screen. The joystick lever is movable along x and y axes to control respective left and right and up and down movement of the image on the screen, and also diagonally for movement of the image towards the corners of the screen.

Figure 2:
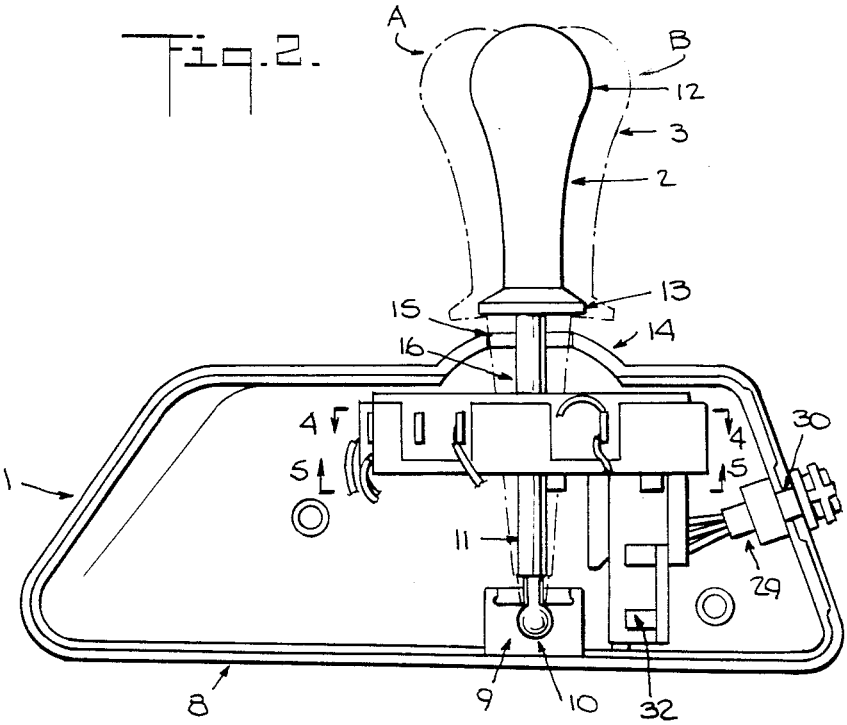
FIG. 2 is a cross-sectional side elevation view of an exemplary joystick assembly according to the invention.
Figure 3:
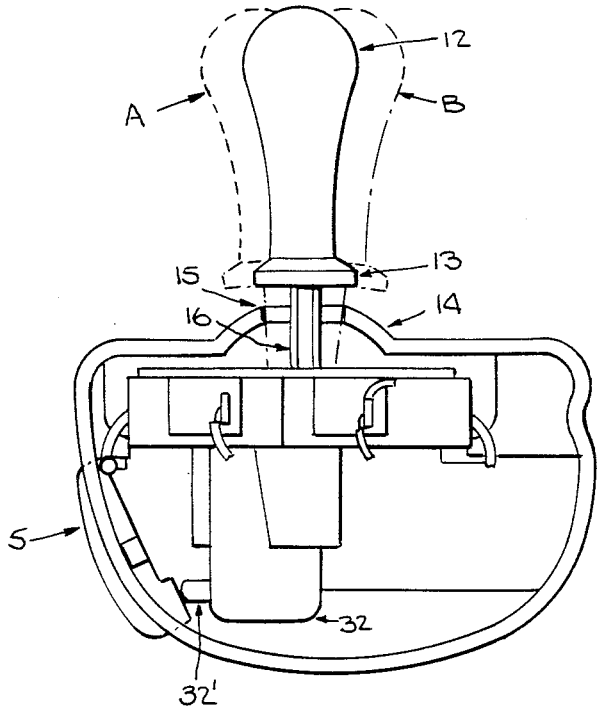
FIG. 3 is a cross-sectional view of the assembly of FIG. 2 taken at right angles thereto.

Referring to FIGS. 2 and 3, in which like parts are denoted by like reference numerals, the housing 1 comprises a convex lower surface or a base 8 having a socket 9 for receiving a part-spherical ball 10, which is connected via a substantially cylindrical shaft 11 to lever 2. Lever 2 comprises a hand-grip 12 and a substantially annular skirt portion 13.

FIG. 3 also illustrates a non-numbered convex lower face of base 8 shown in FIG. 2. The configuration is ergonometrically shaped to allow the housing to be seated in a hand.

Annular skirt portion 13 is spaced from a convex protuberance 14 in the upper face 3 of the housing 1. The protuberance 14 has a circular aperture 15 surrounding the upper part of the shaft 11. The edges of the aperture 15 delimit the freedom of movement of the shaft 11 to the positions shown in dotted lines A and B respectively.

Figure 4:
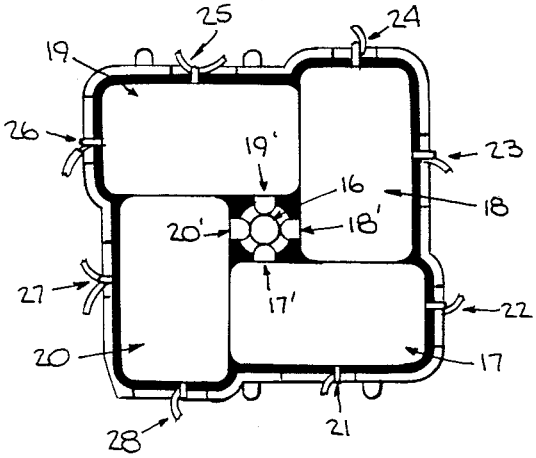
FIG. 4 is a top plan view along line 4—4 in FIG. 2.

Referring to FIG. 4, an intermediate portion 16 of the shaft 11 is surrounded by an array of four microswitches 17, 18, 19, 20. These are arranged so that, in the neutral (vertical) position, the shaft 11 is in contact with each actuator 17', 18', 19', 20' of each microswitch. Thus, by selective manual manipulation of the lever 2 by means of hand-grip 12, the shaft 11 can be made to effect one of the following:

(a) depression of actuator 17' thereby completing an electrical connection between leads 21 and 22;

(b) depression of actuator 18' thereby completing an electrical connection between leads 23 and 24;

(c) depression of actuator 19' thereby completing an electrical connection between leads 25 and 26;

(d) depression of actuator 20' thereby completing an electrical connection between leads 27 and 28;

(e) a combination of (a) and (b);

(f) a combination of (b) and (c);

(g) a combination of (c) and (d); or (h) a combination of (d) and (e).

Leads 21 to 28 are all arranged for connection via wires (not shown) to multi-strand cable 29 which passes through an aperture 30 in housing 1, for connection to an input for a computer game.

Figure 5:
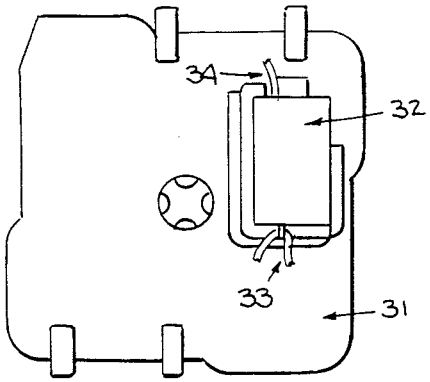
FIG. 5 is a plan view from underneath along line 5—5 in FIG. 2.

Microswitches 17, 18, 19, 20, are all mounted in fixed locations on a moulded carrier 31 seen more clearly in FIG. 5 to the undersurface of which is mounted a further microswitch 32. Note FIGS. 3 and 5. The actuator 32' of the microswitch 32 is in direct contact with the internal surface of fire button 5. The microswitch 32 has further electrical leads 33, 34, for connection via cable 29 to an appropriate input for the computer game.

Microswitches 17, 18, 19, 20, are each provided, within their casings, with resilient springs which bias the respective actuator 17', 18', 19', 20', into contact with the intermediate portion 16 of shaft 11. The resultant force on the shaft 11 is such as to cause it to revert to the neutral (vertical) position when manual manipulation of the joystick ceases.

While one embodiment of the invention has been described in detail, various modifications and variations thereof may be envisaged by those skilled in the art without departing from the scope of the invention, which is defined in the following claims.

What is claimed is:

1. A joystick assembly adapted for support in a hand of an operator of said joystick assembly, comprising:

a housing having a convex lower face adapted to rest in said hand of the operator and an upper face having an aperture therein, said convex lower face being adjacent about a substantially horizontal axis, said housing including a plurality of side walls connecting said lower face to said upper face and having a first side wall of said plurality of side walls with means for receiving said operator's third and fourth fingers of said hand, and said housing further including a portion which is opposed to said first side wall, said portion of said housing having means for receiving a thumb of said hand of said operator in a substantially horizontal orientation;

a joystick shaft having a first end and a second end, said joystick shaft extending through said aperture of said upper face of said housing; and, pivotal mounting means for pivotal connection of said shaft to said housing.

2. The joystick assembly according to claim 1, wherein said joystick shaft further includes a handle provided at substantially said first end of said joystick shaft.

3. The joystick assembly according to claim 1, wherein said pivotal mounting means includes a socket provided in said convex lower face so as to receive said second end of said joystick shaft.

4. The joystick assembly according to claim 1, wherein said joystick shaft is in contact with four microswitch actuators secured in said housing.

5. The joystick assembly according to claim 1, wherein said joystick shaft engages an array of microswitches, secured in said housing, at an intermediate position of said joystick shaft.

6. The joystick assembly according to claim 5, wherein said array of microswitches is an array of four push-button microswitches which is provided on a carrier member secured in said housing so that the push-buttons of said array of four push-button microswitches are in contact with said joystick shaft at said intermediate position of said joystick shaft.

7. The joystick assembly according to claim 1, wherein said joystick shaft is in direct contact with an array of actuators of four microswitches secured in said housing.

8. The joystick assembly according to claim 1, further comprising a microswitch carrier secured in said housing and having mounted thereon an array of four mutually perpendicular push-button microswitches arranged around said joystick shaft so that the push-buttons of said microswitches are all in engagement with at least a portion of said joystick shaft at a position which is intermediate between said first end and said second end of said joystick shaft when said joystick shaft is in a neutral position.

9. The joystick assembly according to claim 8, further comprising a fifth push-button microswitch which is operable externally of said housing, said fifth push-button microswitch being secured in said housing in a substantially perpendicular arrangement to said array of four microswitches.

10. The joystick assembly according to claim 9, further comprising second means for receiving the operator's first finger, a fire button operatively connected to the push-button of said fifth microswitch being provided in said second means for receiving the operator's first finger.

11. The joystick assembly according to claim 10, further comprising third means for receiving the operator's second finger.

12. The joystick assembly according to claim 10, wherein said housing includes a bulbous portion and in which said fifth microswitch and said second means for receiving the operator's first finger are located in said bulbous portion.

13. The joystick assembly according to claim 1, wherein said housing includes a bulbous portion in which a fire button is located within said bulbous portion.

14. The joystick assembly according to claim 1, wherein said convex lower face of said housing rests in the palm of said hand of said operator.

15. The joystick assembly according to claim 1, further comprising a cable which enters said housing at a position remote from the wrist of said operator.

16. A joystick assembly adapted for support in a hand of an operator of said joystick assembly, comprising:

a housing having a convex lower face adapted to rest in said hand of the operator and an upper face having an aperture therein, said housing including a plurality of side walls connecting said lower face to said upper face and having a first side wall of said plurality of side walls with means for receiving said operator's third and fourth fingers of said hand with the tips of said third and fourth fingers being uppermost, and said housing further including a portion which is opposed to said first side wall, said portion of said housing having means for receiving a thumb of said hand of said operator in a substantially horizontal orientation;

a joystick shaft having a first end and a second end, said joystick shaft extending through said aperture of said upper face of said housing; and, pivotal mounting means for pivotal connection of said shaft to said housing.

17. The joystick assembly according to claim 16, wherein said joystick shaft further includes a handle provided at substantially said first end of said joystick shaft.

18. The joystick assembly according to claim 16, wherein said pivotal mounting means includes a socket provided in said convex lower face so as to receive said second end of said joystick shaft.

19. The joystick assembly according to claim 16, wherein said joystick shaft is in contact with four microswitch actuators secured in said housing.

20. The joystick assembly according to claim 16, wherein said joystick shaft engages an array of microswitches, secured in said housing, at an intermediate position of said joystick shaft.

21. The joystick assembly according to claim 26, wherein said array of microswitches is an array of four push-button microswitches which is provided on a carrier member secured in said housing so that the push-buttons of said array of four push-button microswitches are in contact with said joystick shaft at said intermediate position of said joystick shaft.

22. The joystick assembly according to claim 16, wherein said joystick shaft is in direct contact with an array of actuators of four microswitches secured in said housing.

23. The joystick assembly according to claim 16, further comprising a microswitch carrier secured in said housing and having mounted thereon an array of four mutually perpendicular push-button microswitches arranged around said joystick shaft so that the push-buttons of said microswitches are all in engagement with at least a portion of said joystick shaft at a position which is intermediate between said first end and said second end of said joystick shaft when said joystick shaft is in a neutral position.

24. The joystick assembly according to claim 23, further comprising a fifth push-button microswitch which is operable externally of said housing, said fifth push-button microswitch being secured in said housing in a substantially perpendicular arrangement to said array of four microswitches.

25. The joystick assembly according to claim 24, further comprising second means for receiving the operator's first finger, a fire button operatively connected to the push-button of said fifth microswitch being provided in said second means for receiving the operator's first finger.

26. The joystick assembly according to claim 25, further comprising third means for receiving the operator's second finger.

27. The joystick assembly according to claim 25, wherein said housing includes a bulbous portion and wherein said fifth microswitch and said second means for receiving the operator's first finger are located in said bulbous portion.

28. The joystick assembly according to claim 16, wherein said housing includes a bulbous portion in which a fire button is located within said bulbous portion.

29. The joystick assembly according to claim 16, wherein said convex lower face of said housing rests in the palm of said hand of said operator.

30. The joystick assembly according to claim 16, further comprising a cable which enters said housing at a position remote from the wrist of said operator.

31. A joystick assembly adapted for support in a hand of an operator of a joystick shaft, comprising a housing which includes:

a convex lower face adapted to rest in said hand of said operator, said convex lower face being adjacent about a substantially horizontal axis;

an upper face which is to be located at a substantially horizontal position when said convex lower face is resting or located in said hand of said operator; and, a plurality of side walls in which a first side wall of said plurality of side walls includes a slanted-configuration so that said first side wall defines a recessed first portion capable of receiving said operator's third and fourth fingers of said hand and including a second portion of said plurality of side walls which is opposed to said first side wall, said second portion of said plurality of side walls having a groove capable of receiving a thumb of said hand of said operator in a substantially horizontal orientation;

said joystick shaft extending from a bottom pivot located in said convex lower face of said housing and engaging an array of microswitches secured in said housing, at an intermediate position of said joystick.

32. The joystick assembly according to claim 31, wherein said lower face includes a bulbous portion capable of locating said operator's first and second fingers of said hand in a substantially vertical orientation.

33. The joystick assembly according to claim 32, wherein a fire button is located within said bulbous portion of said housing.

34. The joystick assembly according to claim 31, wherein said convex lower face of said housing rests in the palm of said hand of said operator.

35. The joystick assembly according to claim 31, wherein said joystick shaft is in diret contact with said array of actuators of said microswitches secured in said housing.

36. The joystick assembly according to claim 31, further comprising a cable which enters said housing at a position remote from the wrist of said operator.

37. A joystick assembly adapted for support in a hand of an operator of a joystick shaft, comprising a housing which includes:

a convex lower face adapted to rest in said hand of said operator;

an upper face which is to be located at a substantially horizontal position when said convex lower face is resting or located in said hand of said operator; and, a plurality of side walls in which a first side wall of said plurality of side walls includes a slanted-configuration so that said first side wall defines a recessed first portion capable of receiving said operator's third and fourth fingers of said hand with the tips of said third and fourth fingers being uppermost, and including a second portion of said plurality of side walls which is opposed to said first side wall, said second portion of said plurality of side walls having a groove capable of receiving a thumb of said hand of said operator in a substantially horizontal orientation;

said joystick shaft extending from a bottom pivot located in said convex lower face of said housing and engaging an array of microswitches secured in said housing at an intermediate position of said joystick.

38. The joystick assembly according to claim 37, wherein said lower face includes a bulbous portion capable of locating said operator's first and second fingers of said hand in a substantially vertical orientation.

39. The joystick assembly according to claim 38, wherein a fire button is located within said bulbous portion of said housing.

40. The joystick assembly according to claim 37, wherein said convex lower face of said housing rests in the palm of said hand of said operator.

41. The joystick assembly according to claim 37, wherein said joystick shaft is in direct contact with the array of actuators of said array of microswitches secured in said housing.

42. The joystick assembly according to claim 37, further comprising a cable which enters said housing at a position remote from the wrist of said operator.

43. An assembly for control of horizontal movement and vertical movement of a cursor on a display screen, said assembly comprising:

a housing having an upper face and a lower face, said upper face of said housing having an aperture therein;

a joystick shaft having a first end and a second end, said joystick shaft extending through said aperture of said upper face of said housing;

pivotal mounting means for said second end of said joystick shaft, said pivotal mounting means being secured to said lower face of said housing; and an array of four individually actuatable push-button microswitches being secured within said housing and intermediate between said upper face and said lower face, said array of microswitches each having a respective push-button in contact with said joystick shaft in a plane which is substantially perpendicular to said joystick shaft and intermediate between said upper face and said lower face of said housing, said array of microswitches being constructed so that actuation thereof would complete an appropriate electrical connection for control of said horizontal movement or said vertical movement of said cursor, wherein, said joystick shaft is capable of movement from an equilibrium position in which said joystick shaft is in contact with said four pushbuttons of said microswitches, through an array of eight operative positions encircling said equilibrium position, wherein in said operative positions either one of said microswitches of said array of microswitches is actuated by the respective pushbutton thereof, or two of said microswitches of said array of microswitches, being adjacent to one another, are actuated by the respective pushbutton thereof.

44. The joystick assembly according to claim 43, further comprising a handle being provided at substantially said first end of said joystick shaft.

45. The joystick assembly according to claim 43, further comprising a cable which enters said housing at a position remote from the wrist of said operator.

46. The joystick assembly according to claim 43, wherein said lower face of said housing is adjacent about a substantially horizontal axis.

* * * * *